United States Patent [19]

Preston

[11] Patent Number: 4,735,340

[45] Date of Patent: Apr. 5, 1988

[54] TRASH BAG BRACKET

[76] Inventor: John H. Preston, 1362 Battle View Dr., NW., Atlanta, Ga. 30327

[21] Appl. No.: 944,460

[22] Filed: Dec. 19, 1986

[51] Int. Cl.[4] ..... B65D 90/04

[52] U.S. Cl. ..... 220/404; 220/1 T; 248/95; 248/99; 248/100

[58] Field of Search ..... 220/404, 1 T, 403, 461; 248/95, 99, 100

[56] References Cited

U.S. PATENT DOCUMENTS

| | | | |
|---|---|---|---|
| 2,206,421 | 7/1940 | Muehlhofer | 220/404 |
| 2,757,859 | 8/1956 | Holland | 220/404 |
| 3,130,853 | 4/1964 | Colthurst et al. | 220/404 |
| 3,684,155 | 8/1972 | Smith | 220/404 |
| 3,784,049 | 1/1974 | Hawk | 220/404 |
| 3,825,150 | 7/1974 | Taylor | 220/404 |
| 3,977,450 | 8/1976 | Schampier | 220/404 |
| 4,366,916 | 1/1983 | Guido et al. | 220/404 |
| 4,418,835 | 12/1983 | Watts | 220/404 |
| 4,437,634 | 3/1984 | Hambleton | 220/404 |

*Primary Examiner*—Joseph Man-Fu Moy
*Attorney, Agent, or Firm*—Cort Flint

[57] ABSTRACT

This invention relates to a bracket for retaining and supporting limp plastic bags as liners in a trash receptacle. The bracket includes leg means for clamping onto the upper rim of the trash receptacle and includes two or more projections, upwardly extending, to engage openings within said limp flexible plastic liner for holding and retaining said liner in the trash receptacle.

15 Claims, 3 Drawing Sheets

TRASH BAG BRACKET

BACKGROUND OF THE INVENTION

The present invention relates generally to a bracket for use with a household trash container, and more particularly to a bracket for holding a removable liner for such household trash containers.

The use of household trash containers for temporarily containing trash and the like and the use of removable lining materials for keeping the interior of the outer trash container clean and sanitary is well known in the art. One type of trash container lining in widespread use is an oversized plastic bag that may be placed within the cavity of a trash container. Plastic linings of this type are generally of sufficient length to allow the outer peripheral rim of the liner to be folded back over the outer rim of the trash receptacle or container for the purpose of providing vertical support to the walls of the liner and thereby preventing the liner from slipping down into the container itself.

Another commonly used liner for trash containers is the common paper grocery bag of a size approximately the size of the trash container cavity. Such paper grocery bags are generally of insufficient length to be folded back over the rims of the conventional sized kitchen trash container, but the structural rigidity of the paper is generally sufficient to maintain the paper bag in an upright position within the trash container. The outer walls of the trash container in both cases provides lateral support for the liner and prevents rupture and tearing of the liner from various stresses generated by the weight of the material placed within the receptacle. The advantage of plastic liners over the paper bags have been that the plastic liners are generally stronger and impervious to fluids and, thus, may be removed from the household container and carried directly to an outdoor container without tearing or rupturing the liner. The advantage of the paper grocery bags has been that they are generally free, recyclable material which may be used at no cost to the home owner.

It has recently become a custom of many grocery store chains to switch from paper grocery bags or sacks to plastic grocery sacks of approximately the same size of the paper bags being replaced. The new plastic grocery sack has two cut out portions in the upper lateral sides of the sack to provide an opening at the top of the sack which provides two carrying straps which may be placed together and held with one hand by the customer to provide ease in transporting the groceries contained in the sack. However, such plastic grocery sacks have been unusable as trash container liners since the plastic material does not have sufficient structural rigidity to maintain the plastic sack in an upright position within the trash container and such sacks do not have sufficient length to allow folding over the upper rim of the trash container.

U.S. Pat. No. 4,418,835 issued Dec. 6, 1983 to Abner W. Watts, discloses a bracket for mounting limp, plastic grocery bags in a trash container. The bracket in this patent comprises a wire bracket which is bolted to the sides of the trash container and has two ear portions about which the opening forming the handle is draped or hooked. Such a bracket is provided on two sides of a rectangular container. There are a number of problems that arise with a bracket of the type disclosed in this patent. One problem is that the plastic sacks are held below the surface of the rim of the receptacle and the lining, limp plastic sack generally tends to overflow before the receptacle is filled with trash or garbage, thus making it difficult for the filled sack to be removed from the container, and often unsanitary for the user. Another problem is that the bracket is held in place by two bolts which must penetrate what is usually a rigid plastic receptacle and the holes within the receptacle usually weaken the structure of the receptacle itself; thus the receptacle may fail during usage especially where heavy loads are placed within the plastic liner.

SUMMARY OF THE INVENTION

The present invention comprises bracket means which may be removably positioned atop the upper rim of a rectangular or circular trash receptacle to support the limp plastic grocery sacks in an upright position, stretched open at the upper surface or rim of the trash receptacle to allow convenient insertion of materials or trash therein without risking overflowing of the liner.

It is an object of the present invention to provide a bracket which is readily removable but attachable to the upper rim of a circular or rectangular trash receptacle for holding limp plastic sacks for use as liners within such receptacles.

It is another object of the invention to provide a bracket which will hold a variety of limp plastic sacks as liners without requiring a changing of the bracket.

The present invention provides a bracket which includes means for clamping onto the upper rim or perimeter of the trash receptacle for holding limp plastic sacks as liners for such receptacles. The bracket of the invention has a plurality of projecting lobes for engaging a variety of different sized openings within the top rim of such limp plastic sacks to support them within the receptacle. Furthermore, where such sacks do not have openings they may be folded over the upper rim of the receptacle and the bracket of the invention may be used to clamp such sacks about the upper rim of the trash receptacle to hold it upright within the receptacle.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown, and wherein.

DESCRIPTION OF A PREFERRED EMBODIMENT

Figure 1:
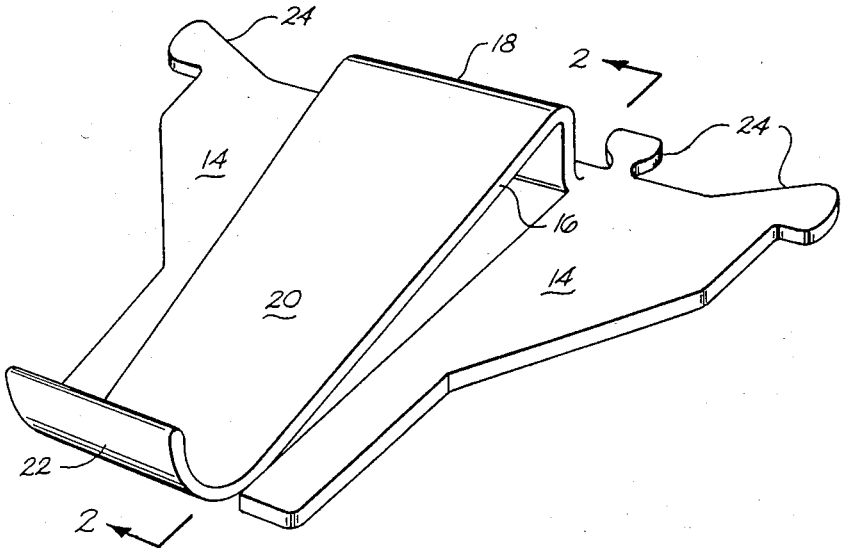
FIG. 1 is a perspective view of the bracket of the invention.

As illustrated in FIG. 1, the bracket 10 of the present invention comprises a body portion 12 with two outside leg portions 14 extending downwardly from the body portion in substantially the same plane as the body portion. Interposed between outside legs 14 is a middle or inside leg 16 which also extends generally downwardly from body portion 12.

Middle leg 16 comprises a horizontal ledge portion 18 which extends at a generally right angle to the body portion 12. Extending downwardly from ledge 18 is a downward portion 20 of the middle or inside leg, which is inclined downwardly towards the plane of the outside leg 14. Downward portion 20 terminates in a curved portion 22.

Body portion 12 has a plurality of upwardly extending sack hanging lobes or ears 24, from which a limp plastic sack may be hung, i.e. the opening forming the handle in the limp plastic sack may be fitted about the upwardly protruding ears or lobes 24 to thereby retain the sack in place. Plastic sacks are found utilized with a variety of non-standard handle openings. The arrangement of projections 24 provides attachment for a variety of different size, i.e. width, sack openings.

Figure 3:
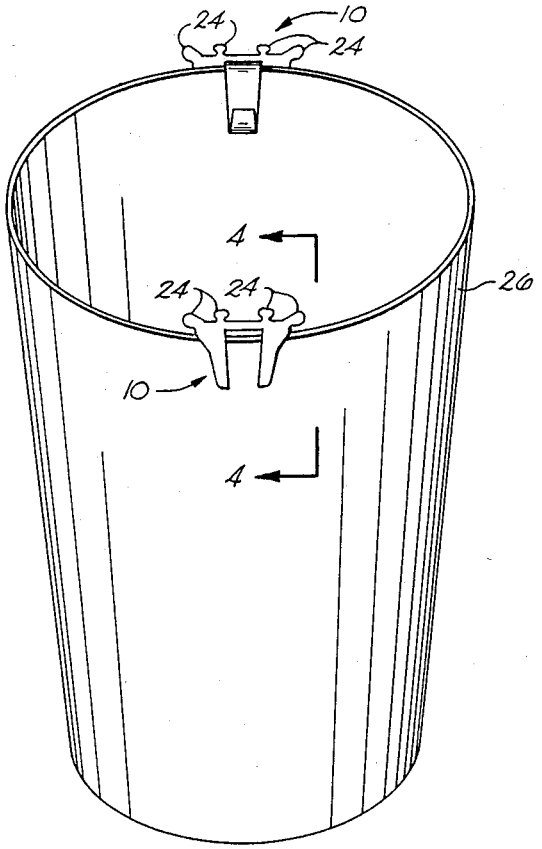
FIG. 3 is a perspective view of a household trash container, with two of the brackets of the invention attached thereto.
Figure 4:
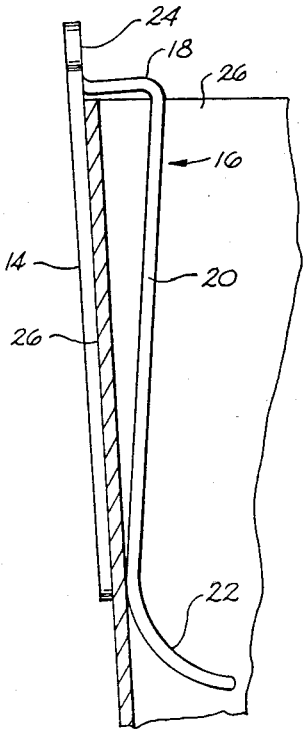
FIG. 4 is a view taken along line 4—4 of FIG. 3, with some parts shown in section.

Referring now to FIGS. 3 and 4, wherein a typical household trash receptable 26 is illustrated with two of the brackets of the invention attached thereto. The construction of the bracket of the invention is such that it will readily fit a circular trash receptacle as well as a rectangular one and is firmly connected thereto for supporting the limp plastic sack. As shown in FIG. 3, the trash receptacle 26 is provided with a pair of the brackets of the invention so as to hold two sides of the limp plastic sack in place during usage as liners for the trash receptacle.

Figure 2:
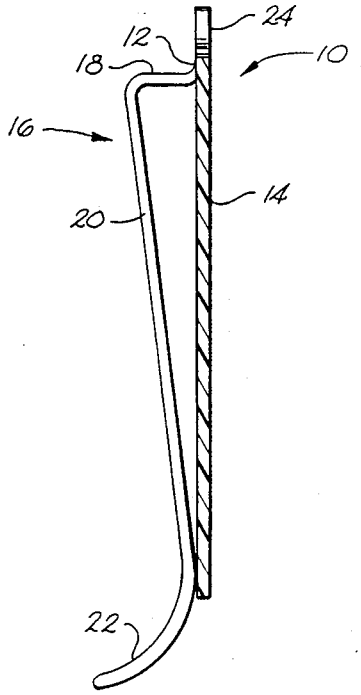
FIG. 2 is a side view, partly in section, of the bracket of FIG. 1, taken generally along line 2—2 of FIG. 1.
Figure 5:
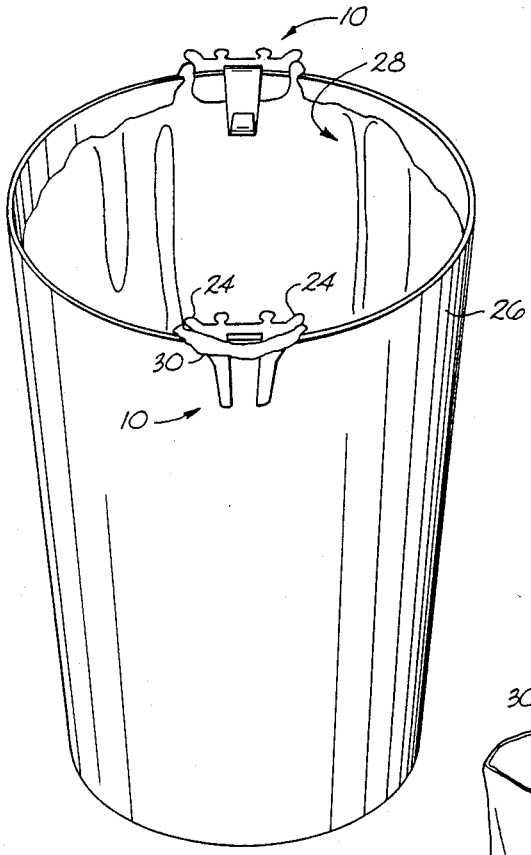
FIG. 5 is a perspective view of a household trash container having two brackets of the invention affixed thereto supporting a plastic sack therein.

Reference is now had to FIGS. 4 and 5. FIG. 4 is a view similar to FIG. 2, showing how the bracket of the invention clamps onto the rim of the trash receptacle while FIG. 5 is a view similar to that of FIG. 3 which shows the limp plastic sack in place in the trash receptacle and being supported by the bracket of the invention.

Figure 6:
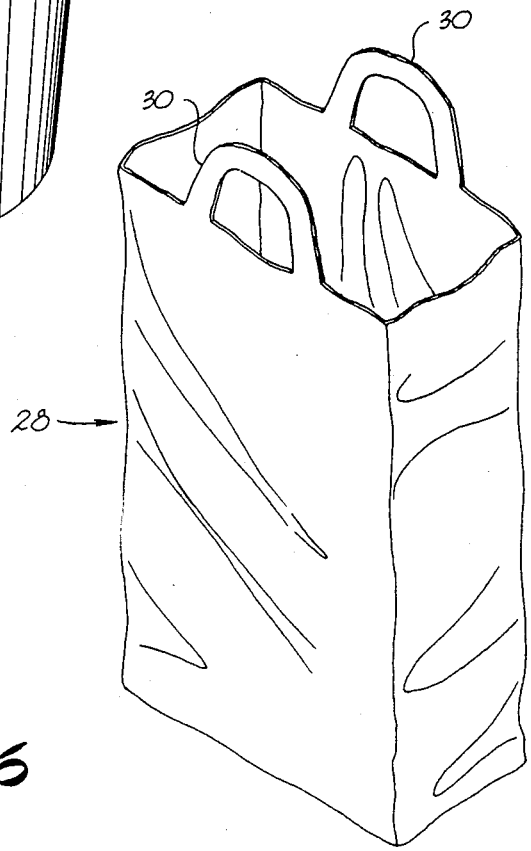
FIG. 6 is a perspective view of a limp plastic sack of the type useful with the invention.

FIG. 6 illustrates the typical limp plastic sack used by grocery stores and the like which may be held by the bracket of the invention, as noted above. As noted, sack 28 is made of very thin limp plastic with two handles 30 for ease in carrying by the customer. It is these handles that are used to hang about ears or lobes 24 to maintain the limp plastic sack at the upper rim of the trash container.

The bracket of the invention may be constructed from metal or from a thermoplastic or any other material that has the desired resiliency that enables the middle leg, in conjunction with the outside legs, to clamp the bracket onto the rim of the trash receptacle.

It has also been found that the bracket of the invention is useful in retaining the usual trash container liners which have no openings in the sack. In this case the liner is folded over the rim of the trash receptacle and the bracket of the invention is snapped into place about the rim of the trash receptacle and clamps the limp plastic sack in place holding it firmly, while the sack is being filled during the normal usage of the waste receptacle. This avoids having the limp plastic sack climb over the rim and go into the receptacle itself, thereby permitting the trash or refuge to contaminate the trash receptacle or container.

Although the present invention has been described with reference to a preferred embodiment of the bracket, it is to be understood that modifications and variations may be resorted to without departing from the spirit and scope of the invention, as those skilled in the art will appreciate. The present embodiment is, therefore, to be considered in all respects as illustrated and not restrictive, the scope of the invention being indicated by the claims rather than by the foregoing description, and all changes which come within the meaning and range of the equivalence of the claims are therefore intended to be embraced therein.

While a preferred embodiment of the invention has been described using specific terms, such description is for illustrative purposes only, and it is to be understood that changes and variations may be made without departing from the spirit or scope of the following claims.

What is claimed is:

1. A bracket for holding a limp plastic sack having at least two openings adjacent the top rim of said sack and a body portion, in place in a trash receptacle, said bracket comprising:

(a) a body portion adapted to rest on the top rim of said trash receptacle;

(b) first and second spaced outside legs, extending downwardly from said body portion, adapted to contact one side of one wall of said trash receptacle when said body portion rests on the top rim of said trash receptacle;

(c) an inside leg, extending generally downwardly from said body portion and interposed between said first and second outside legs and adapted to contact the other side of said one wall of said trash receptacle when said body portion rests on the top rim of said trash receptacle; and (d) at least two projections extending upwardly from said body portion for engagng one of said openings in said sack for supporting said sack in said trash receptacle.

2. A bracket as set forth in claim 1, wherein said inside leg comprises a ledge portion which extends from said body portion of said bracket at an angle to said body portion and includes a downwardly extending portion in a plane which intersects the plane of said outside legs.

3. A bracket as set forth in claim 2, wherein said ledge portion of said inside leg extends from said body portion at a ninety degree angle.

4. A bracket as set forth in claim 1, wherein said bracket is composed of a resilient material which causes the middle legs and the inside leg to clamp the wall of the trash receptacle when the body of said bracket is in position on the upper rim of the trash receptacle.

5. A bracket as set forth in claim 4, wherein said bracket is composed of a resilient metal material.

6. A bracket as set forth in claim 4, wherein said bracket is composed of a resilient plastic material.

7. An improved trash receptacle comprising:

(a) an outer container for structurally supporting and enclosing a liner positioned therein, said receptacle comprising wall means and an upper rim defining an opening for receipt of trash or other refuge;

(b) a flexible, limp, plastic inner liner, operably positioned within said outer receptacle for receiving material to be disposed of therein, said limp, flexible, plastic liner being formed from a limp, flexible, extendable plastic film material constructed and arranged to form a deformable enclosing envelope; and (c) at least a pair of brackets for removably supporting said limp, flexible, plastic liner within said outer receptacle, each of which are clamped onto said upper rim of said receptacle in spaced positions and having means for retaining the upper rim of said limp, flexible, plastic liner adjacent the upper rim of said outer receptacle, whereby said limp flexible plastic liner is retained in place and in an open condition for receipt of refuge disposed of in said receptacle;

(d) each of said brackets comprising a body portion adapted to rest on the top rim of said receptacle, outside leg means extending downwardly from said body portion in contact with one side of one wall of said receptacle an inside leg extending downwardly from said body portion, between said outside leg means in contact with the other side of said one wall of said receptacle; and (e) at least two projections extending upwardly from said body portion for engaging an opening in said limp, flexible liner for supporting said liner in said receptacle.

8. An improved trash receptacle as set forth in claim 7, wherein said inside leg comprises a ledge portion which extends from said body portion of said bracket at an angle to said body portion and includes a downwardly extending portion plane which intersects the plane of said outside legs.

9. An improved trash receptacle as set forth in claim 8, wherein said ledge portion of said inside leg extends from said body portion at a ninety degree angle.

10. An improved trash receptacle as set forth in claim 7, wherein said bracket is composed of a resilient material which causes the outside leg means and the inside leg to clamp the wall of the trash receptacle when the body of said bracket is in position on the upper rim of the trash receptacle.

11. An improved trash receptacle as set forth in claim 10, wherein said bracket is composed of a resilient metal material.

12. An improved trash receptacle as set forth in claim 10, wherein said bracket is composed of a resilient plastic material.

13. A bracket for holding a limp plastic sack having at least two openings adjacent the top rim of said sack and a body portion, in place in a trash receptacle, said bracket comprising:

(a) a body portion adapted to rest on the top rim of said trash receptacle;

(b) bifurcated leg means extending downwardly from said body portion adapted to contact one side of one wall of said trash receptacle when said body portion rests on the top rim of said trash receptacle, and said leg means being bifurcated to facilitate placement of said body portion on curved or planar walls;

(c) at least one inside leg extending downwardly from said body portion adapted to contact the other side of said one wall of said trash receptacle when said body portion rests on the top rim of said trash receptacle;

(d) a plurality of projections extending upwardly from said body portion for engaging one of said openings in said sack for supporting said sack in said trash receptacle, said plurality of projections providing for engaging openings of different sizes in a manner that a wide variety of plastic sacks may be utilized; and (e) a generally horizontal ledge carried by said body portion extending between said bifurcated leg means and said inside leg for supporting said body portion on said top rim of said trash receptacle, and said projections extending well above said horizontal ledge so that the top edge of said sack is carried generally flush with the top of said trash receptacle when said openings of said sack are engaged by said projections and attached to said trash receptacle thereby.

14. The device of claim 13, wherein said bracket is formed of a resilient plastic material and said inside leg extends downwardly at an angle from said generally horizontal ledge in such a manner that a resilient bias is exerted by said inside leg against said one wall of said trash receptacle when said body portion is resting on the top rim of said trash receptacle with said bifurcated legs and said inside legs engaging opposing sides of said trash receptacle wall.

15. The device of claim 14 wherein a lower end of said inside leg includes an smooth outwardly curved surface facilitating easy insertion of said bracket over the top rim of said trash receptacle.

* * * * *